US008723665B2

(12) United States Patent
Foisy et al.

(10) Patent No.: US 8,723,665 B2
(45) Date of Patent: May 13, 2014

(54) AUDIO BUFFERING IN TWO-WAY VOICE ALARM SYSTEMS

(75) Inventors: Stephane Foisy, Udora (CA); Derek Smith, Maple (CA); Oscar Noyola, Woodbridge (CA); Reyzaldi Sacuevo, Whitby (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 221 days.

(21) Appl. No.: 13/191,052

(22) Filed: Jul. 26, 2011

(65) Prior Publication Data

US 2013/0027197 A1 Jan. 31, 2013

(51) Int. Cl.
*G08B 29/00* (2006.01)

(52) U.S. Cl.
USPC ..... 340/506; 340/539.1; 340/691.1

(58) Field of Classification Search
USPC ..... 340/506, 531, 540–541, 539.1, 539.16, 340/539.17, 691.1, 692, 505
See application file for complete search history.

(56) References Cited

U.S. PATENT DOCUMENTS

| | | | | |
|---|---|---|---|---|
| 5,400,011 | A | 3/1995 | Sutton | |
| 5,736,927 | A * | 4/1998 | Stebbins et al. | 340/506 |
| 6,504,479 | B1 * | 1/2003 | Lemons et al. | 340/541 |
| 6,618,074 | B1 * | 9/2003 | Seeley et al. | 348/143 |
| 6,658,091 | B1 | 12/2003 | Naidoo et al. | |
| 7,120,233 | B2 * | 10/2006 | Naidoo et al. | 379/37 |
| 7,158,026 | B2 * | 1/2007 | Feldkamp et al. | 340/531 |
| 8,248,226 | B2 * | 8/2012 | Friar | 340/506 |
| 2006/0104312 | A1 | 5/2006 | Friar | |
| 2007/0143106 | A1 * | 6/2007 | Dunsmuir | 704/233 |
| 2012/0231758 | A1 * | 9/2012 | Sharma et al. | 455/404.1 |

OTHER PUBLICATIONS

Patent Cooperation Treaty, International Search Report, mailed Oct. 1, 2012, for International Application No. PCT/CA2012/000666.

* cited by examiner

*Primary Examiner* — Daniel Previl
(74) *Attorney, Agent, or Firm* — Smart & Biggar

(57) ABSTRACT

An alarm system includes an alarm panel that signals sensed alarm conditions at a premises to a monitoring server over a packet switched data network. The alarm panel also senses and buffers audio at the premises. In response to a sensed alarm condition, buffered audio, buffered prior to signalling the sensed alarm condition, is transferred to the monitoring station. The alarm panel may further receive live audio from the premises. Data representing live audio and buffered audio may be transferred concurrently, allowing an operator at a monitoring center to listen to audio arising from events before and after an alarm is signalled. The alarm system may further allow real-time communication between the monitoring center and panel.

23 Claims, 4 Drawing Sheets

AUDIO BUFFERING IN TWO-WAY VOICE ALARM SYSTEMS

FIELD OF THE INVENTION

The present invention relates generally to security systems, and more particularly to methods and devices for buffering audio at an alarm monitoring station using two-way voice alarm systems.

BACKGROUND OF THE INVENTION

It is common for businesses and homeowners to have a security system for detecting alarm conditions at their premises and reporting these to a monitoring station. One of the primary functions of the monitoring station is to notify a human operator when one or more alarm conditions have been sensed by detectors installed at a monitored premise.

Detectors may vary from relatively simple hard-wired detectors, such as door or window contacts to more sophisticated battery operated ones, such as motion and glass break detectors. The detectors may all report to an alarm control panel at the premises. The control panel is typically installed in a safe location and is connected to a power supply. The control panel is further in communication with the individual detectors to communicate with or receive signals from individual detectors. The communication between the alarm control panel and the detectors can be one or two way, and may be wired or wireless.

Communication between the premises and the monitoring station is typically effected using any of a number of communications networks, including the public switched telephone network (PSTN); a cellular telephone or data network; a packet switched network (e.g. the Internet), or the like.

Recently, equipping the premises with audio microphones and speakers to communicate with the monitoring station has become commonplace. Microphones provide audio signals, representing audio sensed at the microphone to the monitoring station, thereby allowing the monitoring station to monitor audio at the premises in case of an alarm condition. The speakers, in turn, allow an operator at the monitoring station to speak with the premises in real-time. Conveniently, an operator at the monitoring station may listen and react to events at a monitored premise, as they occur. For example, the operator at the monitoring station may speak to an occupant or intruder upon being notified of an alarm condition.

Unfortunately, events giving rise to the alarm condition, or those occurring immediately after sensing of the alarm condition may be most critical. Often audio associated with these is not heard by an operator at the central monitoring station as an audio channel to the operator may not yet have been established, or the audio channel may not have been routed to an operator, or the operator may simply not react quickly enough in focusing his/her attention to the audio channel.

Accordingly, there remains a need for methods and devices that allow better capture of audio related to sensed alarm conditions in alarm systems.

SUMMARY OF THE INVENTION

Exemplary of embodiments of the present invention, an alarm system includes an alarm panel that signals sensed alarm conditions at a premises to a monitoring server over a packet switched data network. The alarm panel may sense and may buffer audio at the premises. In response to a sensed alarm condition, buffered audio, buffered prior to signalling the sensed alarm condition, may be transferred to the monitoring station. The alarm panel may further receive live audio from the premises. Data representing live audio and buffered audio may be transferred concurrently, and even before a connection has been routed to an operator at a monitoring station, allowing the operator to listen to audio arising from events before and after an alarm is signalled. The alarm system may further allow real-time communication between the monitoring center and panel.

In accordance with an aspect of the present invention, there is provided a method of operating alarm monitoring station, comprising: receiving an alarm signal from an alarm system at a monitored premises; establishing an audio communication channel between the monitoring station and the alarm system; upon establishing the audio communication channel with the premises, and at least prior to establishing a connection with an operator associated with the monitoring station, receiving audio data from the premises at the monitoring station; buffering the audio data from the premises at the monitoring station.

In accordance with another aspect of the present invention, there is provided an alarm monitoring station in communication with an alarm system at a premises. The monitoring station comprises: a buffer for buffering audio sensed at the premises, provided by the alarm system; a network interface interconnecting the alarm system to a network; a processor, operable to cause the alarm system to receive notification of an alarm condition from the alarm system over the network; establish a voice communication channel with the alarm system at the premises; upon establishing the audio communication channel with the premises, and at least prior to establishing a connection with an operator associated with the monitoring station, receive audio data from the premises; and buffer the audio data from the premises at the monitoring station In accordance with yet another aspect of the present invention, there is provided an alarm monitoring server, comprising: a network interface interconnecting the alarm monitoring server to at least one network for receipt of alarm signals and two-way audio communication; a buffer for buffering received at the alarm monitoring server; a processor, operable to cause the alarm monitoring server to receive an alarm signal; establish two-way audio communication with an alarm panel originating the alarm signal; buffer audio received from the alarm panel as part of the two-way audio communication; receive audio buffered at the alarm panel prior to the panel having originated the alarm signal.

In accordance with yet another aspect of the present invention, there is provided a method of operating an alarm panel that signals sensed alarm conditions at a premises to a monitoring server over a packet switched data network. The method comprises: buffering audio at the premises; contacting a monitoring station and signalling a sensed alarm condition; and transferring buffered audio buffered at the premises prior to signalling the sensed alarm condition to the monitoring station.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
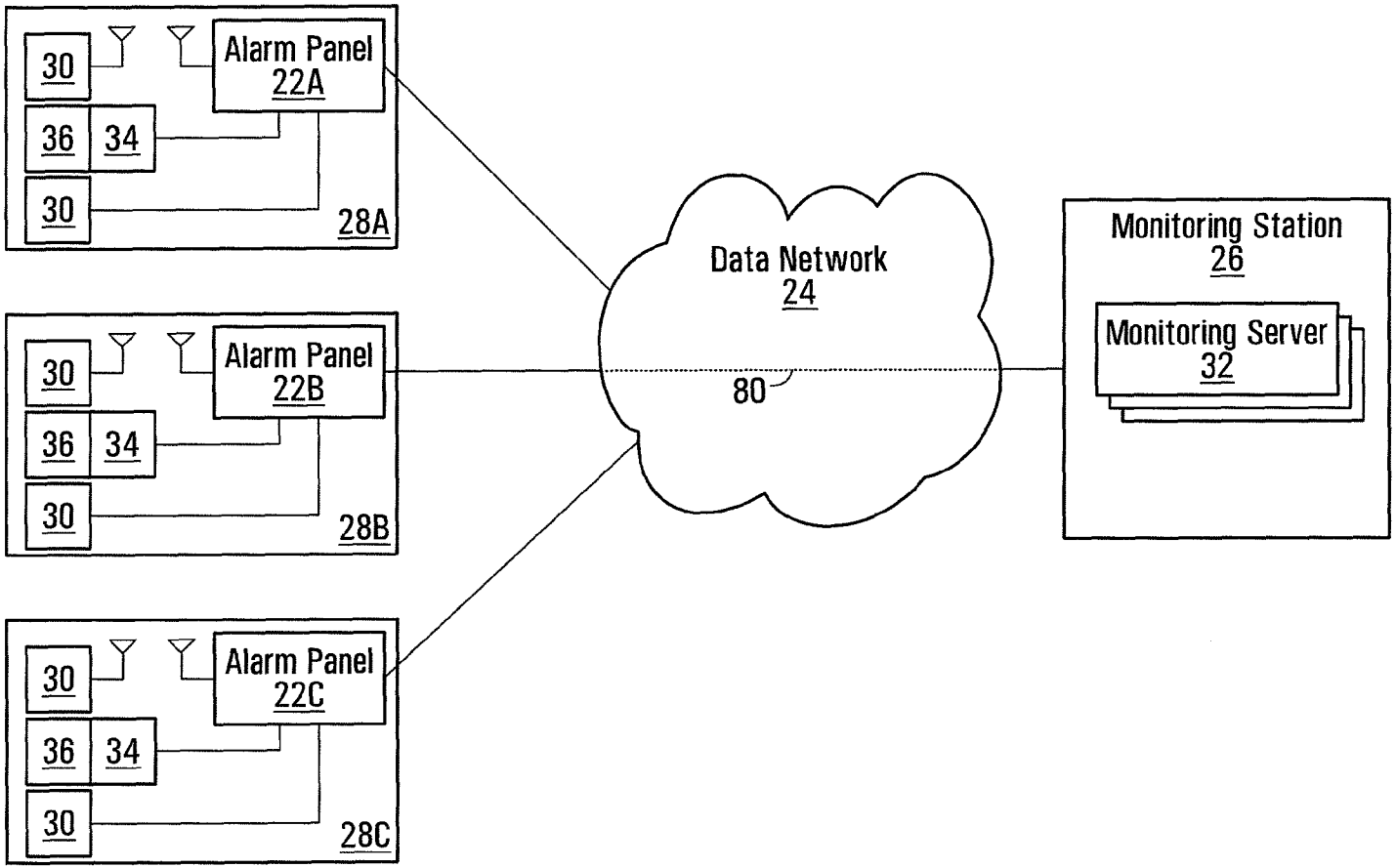
FIG. 1 is a schematic diagram of an alarm system, exemplary of an embodiment of the present invention.

FIG. 1 depicts an exemplary security system infrastructure 20 of security systems including multiple alarm panels 22*a*, 22*b*, 22*c* (individually and collectively panel 22) at customer premises 28*a*, 28*b*, 28*c* (individually and collectively premises 28), respectively, communicating through a data network 24 such as the Internet, with a central monitoring station 26. As will be appreciated, data network 24 may be any combination of wired and wireless links capable of carrying packet switched traffic, and may span multiple carriers, and a wide geography. In one embodiment, data network 24 may simply be the public Internet. Further access points, such as routers, DSL modems, wireless radios, and the like possibly interconnecting panels 22 with data network 24 are not illustrated. Likewise, only three premises 28 are illustrated for clarity.

At residential or business premises 28, each alarm panel 22 may be interconnected with one or more detectors 30. Each of detectors 30 provides information regarding the status of the monitored premises 28 to a local alarm panel 22. Detectors 30 may include, for example, motion detectors, glass break detectors, and contact switches. Detectors 30 may be hard wired to alarm panel 22 or may communicate with alarm panel 22 wirelessly, in manners known to persons of ordinary skill in the art. Alarm panel 22 may further include other interfaces such as key pads, sirens, and the like, not specifically shown in FIG. 1.

One particular detector 36, forming part of system infrastructure 20, is an audio input transducer that acts as a microphone, and allows audio at premises 28 to be sensed. Electrical signals corresponding to the sensed audio are provided to panel 22. The electrical signals may be analog or digital signals that may be compressed, either proximate audio detector 36 or at panel 22. In the event the signals are digital, they may be encoded at the audio detector 36.

Additionally, an alarm system at a premises 28 further includes another audio transducer that acts as a loud speaker (hereinafter speaker 34) to reproduce audio from panel 22. Electrical signals corresponding to the audio are provided by panel 22. The electrical signals may again be analog or digital signals that may be compressed.

Links between panel 22 and audio detector 36 and speaker 34 may be wired or wireless.

Figure 2:
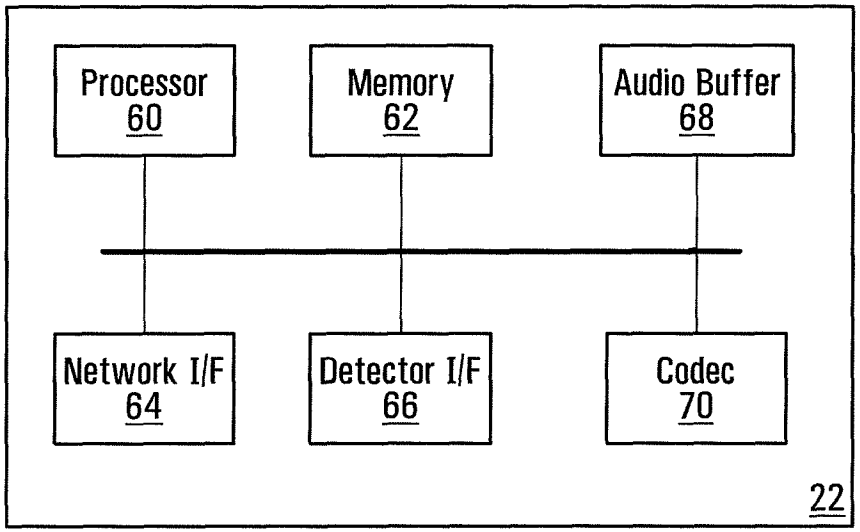
FIG. 2 is a schematic block diagram of a panel in the alarm system of FIG. 1, exemplary of an embodiment of the present invention.

As illustrated in FIG. 2, a typical alarm panel 22 includes a processor 60; memory 62 in communication with processor 60; a detector interface 66 for communication with detectors 30/36; speaker 34; and a network interface 64 for communication with data network 24. Panel 22 further includes an audio/voice coder/decoder (codec) 70, and optionally an audio buffer 68, as further described below.

Memory 62 stores program instructions and data used by processor 60 of alarm panel 22. Memory 62 may be a suitable combination of random access memory and read-only memory, and may host a suitable firmware, operating software, and may be organized as a file system or otherwise.

Example alarm panels may comprise DSC® models PC1864 and PC9155, SCW915x suitably modified to operate as described herein.

As will become apparent, panel 22 under software control may be capable of establishing three (3) separate communications paths to a monitoring center 26: one signals alarm conditions to monitoring center 26; one provides audio to monitoring center 26; and one receives audio from monitoring center 26. In the depicted embodiment data network 24 may be used to carry all three paths. However, a skilled person will readily recognize that the three communications paths could be transported over separate networks—such as the PSTN, a wireless network, the internet or the like. Optionally, panel 22 may further establish a fourth data path to monitoring center 26, as further described below.

To this end, program instructions stored in memory 62 of panel 22 may further store software components allowing network communications and establishment of connections across data network 24. The software components may, for example, include an internet protocol (IP) stack, and a session initiation protocol (SIP) client, and a suitable voice over IP (VoIP) client. Of course, other software components suitable for establishing a connection and communicating across network 24 will be apparent to those of ordinary skill.

Program instructions stored in memory 62 of alarm panel 22, along with configuration data may control overall operation of panel 22. In particular, one or more data network addresses may be stored in memory of alarm panel 22. These network addresses may include the IP network addresses by which monitoring station 26 may be reached. Alarm panel 22 may send data associated with sensed alarm conditions sensed at premises 28 to central monitoring station 26.

Panel 22 may further include a voice codec 70 in communication with audio detector 36 and speaker 34 to encode voice detected at detector 36, and to decode voice data received from monitoring station 26. Voice codec 70 may, for example, be a voice coder encoder (and decoder), compliant with ITU Recommendation G.711, G.723, G.729, or any other known voice coding algorithm or standard. Voice codec 70 may be a hardware component separate from the processor of panel 22, and is illustrated as such in FIG. 2, or may be formed in software, stored for example in memory 62 for execution by the processor of panel 22.

Panel 22 may further include a buffer 68, operable to buffer audio captured at audio detector 36. Buffer 68 may take the form of memory, for storing a finite length of digital data, provided by voice codec 70. Buffer 68 may alternatively be formed within memory 62, as for example, a file stored in a file system hosted in memory 62. Buffer 68 is optional and may be omitted in embodiments of the present invention.

Figure 3:
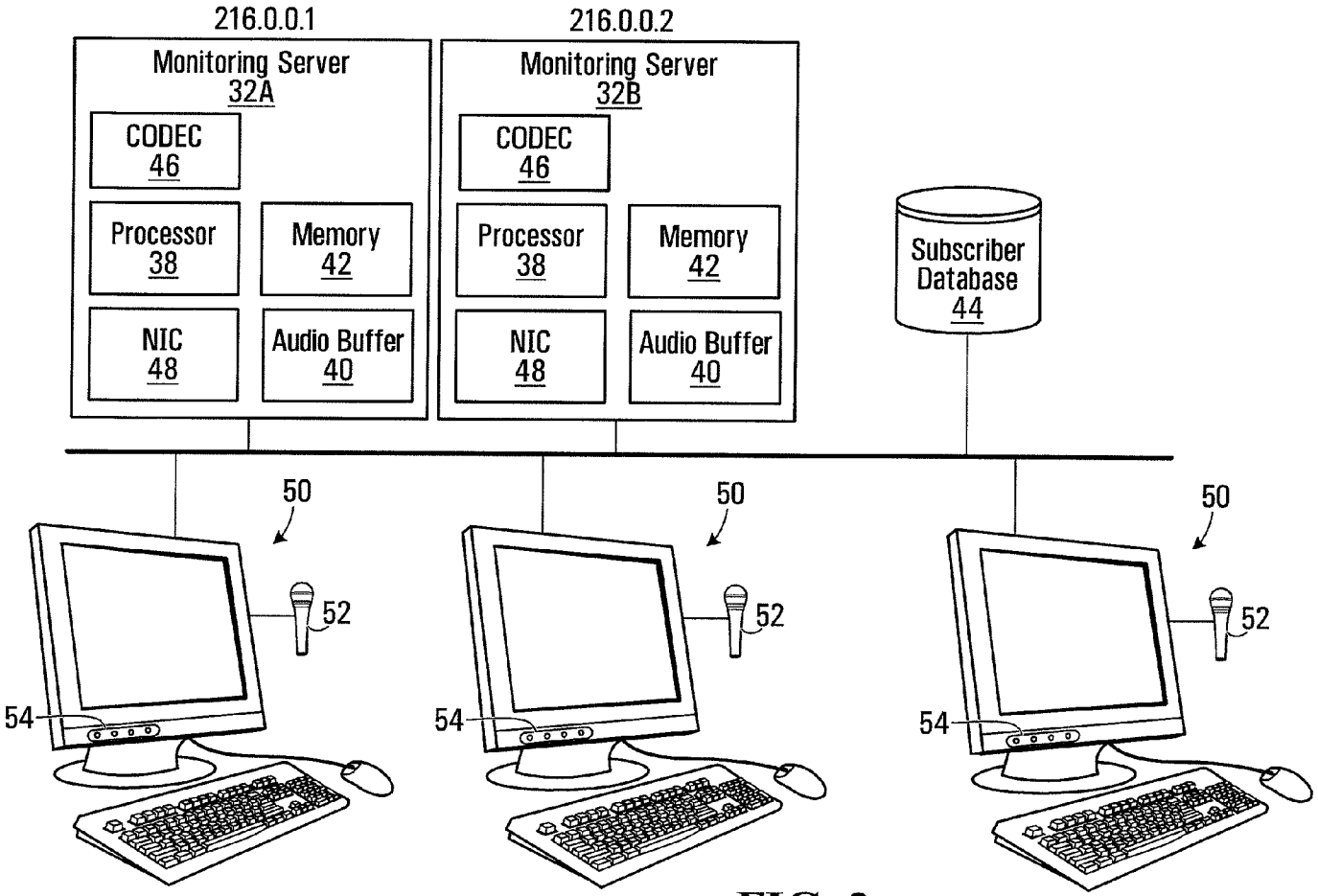
FIG. 3 is a schematic block diagram of a central monitoring station in the alarm system of FIG. 1.
Figure 4:
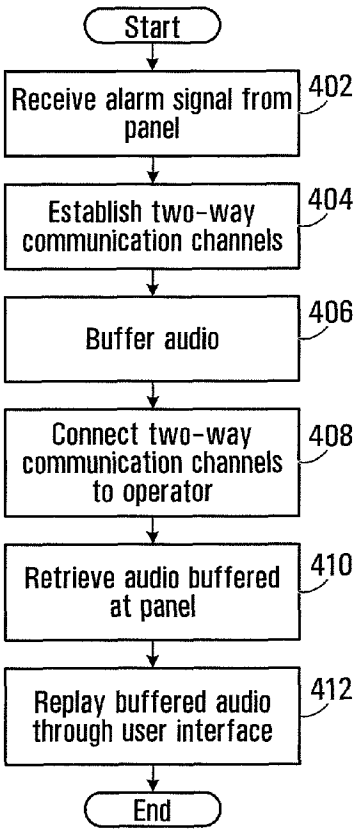
FIG. 4 is a flow diagram depicting steps performed at the central monitoring station of FIG. 1, exemplary of an embodiment of the present invention.

Central monitoring station 26 is more particularly illustrated in FIG. 3. Monitoring station 26 is depicted as a single monitoring station in FIG. 1; however, it could alternatively be formed of multiple monitoring stations, each at a different physical location, and each in communication with data network 24. In particular, in order to process a high volume of alarm conditions from a large number of subscribers, central monitoring station 26 includes a plurality of monitoring servers 32. Each monitoring server 32 processes alarm messages from panels 22 of subscribers serviced by monitoring station 26. Additionally, a monitoring server 32 may take part in two-way audio communication over network 24, with an interconnected panel 22.

Each monitoring server 32 may include a processor 38, network interface 48 and memory 42. Monitoring servers 32 may physically take the form of rack mounted cards. Monitoring servers 32 may be in communication with one or more operator terminals 50. An example monitoring server 32 may comprise a SUR-GARD™ SG-System III Virtual Receiver, available from DSC, modified to function as described herein.

Processor 38 of each monitoring server 32 acts as a controller for each monitoring server 32, and is in communication with, and controls overall operation, of each monitoring server 32. Processor 30 may include, or be in communication with memory 42 controlling the overall operation of monitoring server 32. Suitable software enabling each monitoring server 32 to process alarm messages, establish voice connections and encode/decode voice data may be stored within memory 42 of each monitoring server 32. Software may include a suitable internet protocol (IP) stack and applications/clients.

Each monitoring server 32 of central monitoring station 26 may be associated with an IP address and port(s) by which it can be contacted by alarm panels 22 to report alarm events over data network 24, and establish other IP connections. In the depicted embodiment, monitoring server 32*a* is associated with IP address 216.0.0.1; monitoring server 32*b* is associated with IP address 216.0.0.2. These addresses may be static, and thus always identify a particular one of monitoring servers 32 to the computing devices communicating over network 24. Alternatively, dynamic addresses could be used, and associated with static domain names, resolved through a domain name service. As well, in the depicted embodiment, monitoring servers 32 are interconnected on a local area network. A suitable router (not shown) may route data between servers 32 and to a respective server at their associated IP addresses.

Network interface 48 may be a conventional network interface that interfaces with communications network 24 (FIG. 1) to receive incoming signals, and may for example take the form of an Ethernet network interface card (NIC). Terminal(s) 50 may be computers, thin-clients, or the like, to which received data representative of an alarm event is passed for handling by human operators. Each terminal 50 may include a monitor, and a microphone 52, and an audio transducer/speaker 54 to allow audio to be captured and reproduced at terminal 50. Terminal 50 may include suitable terminal emulation software and thin-client software to allow audio to be streamed to/from speaker 54 and microphone 52. An operator at terminal 50 may further be able to establish outgoing telephone calls, to the police or third party security personnel. To that end, terminal 50 may be proximate a PSTN telephone, or may include or have access to voice-over-IP software (running at server 32, or elsewhere) allowing establishment Monitoring station 26 may further include subscriber database 44 that includes a database under control of a database engine. Database 44 may contain entries corresponding to the various subscribers serviced by monitoring station 26. Database 44 may, for example, include the names and addresses, phone number, contact phone number, for each subscriber at premises 28 (FIG. 1). As well, database 44 may include the particulars of each detector 30, the identifier of each panel 22 assigned to a particular subscriber; account information; and the like. Database 44 may further log or archive alarm data received from panels 22, including audio data generated in connection with such alarm events, as further described below.

Monitoring station 26 receives and processes incoming messages from panels 22. Extracted data from the incoming messages may, for example, be overhead, or alarm data. The alarm data may be passed to processor 30, which, in turn, may make decisions under software control based upon that data. In particular, processor 38 may be programmed to initiate certain alarm handling procedures based on the received data.

For example, alarm data extracted from one or more incoming alarm data signals may specify that a particular detector 30 at a particular monitored premise 28 was tripped. Processor 38 may be programmed to notify a human operator at a terminal 50 using the alarm data, for further action. Further action may include the human operator consulting, and calling, one of a list of phone numbers associated with that particular monitored premise, stored in database 44. Database 44 may, for example, include the telephone number(s) of the homeowner and occupants, and the operator may call the homeowner to determine what the problem was/is.

Additionally, as noted, monitoring station 26 and panels 22 may establish voice channels—in particular two-way voice channels 80 (depicted schematically in FIG. 1) allowing individuals audible at audio detector 36 in communication with panels 22 to communicate with a monitoring server 32, through speakers 54 and/or microphones 52 at terminals 50 to allow operators at terminals 50 to communicate with premises 28, in real time. The two-way voice channel 80 may be established using the SIP or similar protocol, and voice data may be encapsulated using the real-time-transmit (RTP) protocol.

In operation, the premises may be monitored by sensors 30 and/or detector 36 to sense an alarm condition. A sensed alarm condition may be signalled to monitoring station 26.

Optionally, any audio sensed at detector 36 at premises 28 may be buffered prior to signalling the sensed alarm condition to monitoring station 26. Specifically, audio sensed at detector 36, may be converted to digital format, and coded into a suitable compressed audio format by codec 70. Sensed audio, as digitized and compressed is stored may then be stored within buffer 68 of panel 22. Audio may be continuously buffered into buffer 68, or buffering may begin in response to initially detecting some sound at detector 36, or in response to some other trigger condition or event. For example, buffering may begin in response to a sensed alarm condition at panel 22. Panel 22 may be configurable to begin audio buffering in response to a specific condition or event. The specific condition may be programmed at panel 22 by an operator or installer, upon alarm system installation/configuration.

If audio is buffered at panel 22, it may be continuously buffered in buffer 68. That is, buffer 68 may function as a circular buffer, buffering data representing a finite sliding window of audio (e.g. 1 min, 5 mins, 10 mins, 30 mins, etc.). In this way, the contents of buffer 68 may continuously hold data representing the past buffered interval (e.g. the last 1 min, 5 mins, 10 mins, 30 mins, etc.) of audio sensed at detector 36. As noted, buffer 68 may be stored in a file for easy transfer/access. In the presence of a trigger event, buffer 68 may cease acting as a circular buffer, and may instead grow larger, to retain data that is captured after (and possibly before) the trigger event, until such data has been transferred as further detailed below.

In the presence of an alarm condition at panel 22, panel 22 generates an alarm message and dispatches it to the assigned monitoring server 32 for that panel 22 using network 24, and the network address (e.g. IP address) of server 32 assigned to that panel. Each alarm message includes at least an identifier of panel 22 originating the message and the sensed condition giving rise to the alarm condition.

Monitoring server 32, upon receipt of the alarm message in block S402 may more particularly identify the panel 22 and associated premises 28 using, for example, database 44, and generate a message or communication (i.e. a phone call, etc) for down stream handling, to eventually dispatch personnel to the monitored premises as required. The message or an indicator thereof may, for example, be dispatched to an operator at one of terminals 50, for further handling.

An operator at monitoring center 26 may be presented with a user interface at terminal 50 to allow the operator to see status information about a signalled alarm—including the address of the premises, the name of the occupant(s), call back numbers, etc. The user interface may be generated by software at terminal 50, or by or in conjunction with software at server 32. For example, a user interface may be provided as an HTML page using HTML code stored at server 32 and presented by a browser hosted at terminal 50. The user interface at terminal 50 could be presented using terminal emulation, or custom software at terminal 50, or in any other way apparent to those of ordinary skill.

Additionally, panel 22 and monitoring server 32 may establish a two way communications path to monitoring station 26, over network 32 in block S404. The communications paths may be established by either panel 22, or monitoring server 32. The two communications path may be voice-over-IP connections, for example using the H.323, MGCP, SIP and/or other suitable protocol(s), using appropriate clients hosted at panel 22 and monitoring station 26. Once established the voice connections may be routed to an operator at monitoring server 32, for example at a terminal 50. This may, for example, be done by serializing the voice data received by the software at server 32 from panel 22, and providing the streamed data to terminal 50, by way of thin client software at terminal 50.

Once the connection is established, audio data provided over the connection may be buffered at monitoring server 32 at block S406. In this way, audio may be buffered at server 32, even before the voice connection is routed to an operator, or before an operator at station 26 is able to give his/her full attention to the voice connection.

At this time buffering, if performed at panel 22 may be halted, as audio is now being forwarded to server 32, and buffered there. More specifically, once a connection from panel 22 to monitoring center 26 has been established, server 32 may signal panel 22 that a connection has been established. In response, and if applicable, software at panel 22 may cause buffering to buffer 68 at panel 22 to cease.

Additionally, any audio stream provided by panel 22 may be placed in an audio buffer 40 for later playback, and eventual archiving. As noted, audio buffer 40 may take the form of disk drive or the like, storing a file system. Audio associated with a sensed alarm condition may be stored in a file that may be date stamped and further tagged with metadata identifying the alarm condition. Metadata may include the identity of the alarm premises, the date and time of the alarm, the alarm condition, and the like.

In block S408, the connection to server 32 may be connected/bridged to a terminal 50 proximate an available operator. The operator at terminal 50 may listen to audio at premises 28 and speak to premises 28 through panel 22. Audio at premises 28 may be picked up by speaker 34, converted to data by codec 70 and provided to monitoring station 32 over network 30, where it may be stored in buffer 40 and decoded for playback at a speaker 54.

Likewise audio spoken into microphone 52 may be encoded by codec 46 at monitoring server 32, or by thin client software at terminal 50. Corresponding data may be provided to panel 22 over connection 80. At panel 22, the audio data from server 32 may be decoded using codec 70. Decoded audio may be provided to transducer (speaker) 34 allowing real-time, two-way, audio communication between monitoring center 26 and panel 22.

As should be appreciated, the most interesting audio at premises 28, associated with a signalled alarm condition is often generated before an operator at monitoring station 26 is in communication with panel 22, because connections 80 have not been established, or because the operator has been busy taking servicing another event. Conveniently, and exemplary of embodiments of the present invention, audio associated with an alarm condition preceding signalling of the alarm condition to center 26, may be buffered in buffer 40 at monitoring center 26. Optionally, audio may also be buffered in buffer 68 at panel 22 as described above.

Software at panel 22 and monitoring center 26 may allow for the retrieval of buffered data at panel 22. Specifically, data within buffer 68 at panel 22 may be transferred to monitoring station 26 in block S410, out-of-band using a further connection, such as an IP connection between server 32 and panel 22. In one embodiment, server 32 may establish a file transfer connection (e.g. an FTP, or similar connection) with panel 22, and the data buffered in buffer 68 at panel 22 may be transferred to buffer 40 at server 32, and merged with audio data buffered at buffer 40 beginning in block S406. For example, the contents of buffer 68 may be transferred to buffer 40 using a file transfer protocol, or any other suitable protocol.

Audio data buffered in buffer 68 may be transferred automatically in block S410, in response to server 32 receiving an alarm notification message, or may be transferred in response to an operator request made by an operator at terminal 50. Conveniently, buffered data is transferred concurrently with data representing live audio (which may be buffered at buffer 40 of server 32).

The transferred data may be pre-pended to data in buffer 40, buffered in block S406. Buffer 40 may thus be filled with data representing events currently occurring, as well as data representing past event (i.e. the data buffered at panel 22) concurrently.

Software at server 32 may further transfer the contents of buffer 40/68 to database 44 (or another database) where it may be associated with a particular alarm subscriber's account, and particulars of a signalled alarm condition (e.g. alarm type, time, etc.), for archival purposes. Once the data has been transferred from buffer 40, buffer 40 may be erased and may be re-used to buffer audio data associated with the next sensed alarm condition. Erasure may occur automatically, or in response to a command received from server 32, that may be provided in response to operator input at terminal 50.

The user interface at terminal 50 further allows the operator to listen to any portion of audio buffer 40, thereby allowing the operator to rewind and listen to audio captured prior to the operator dealing with the alarm event, by presenting the operator at station 26 with a user interface in block S412, allowing replay of buffered audio. The user interface may allow pausing, rewinding, stopping, etc. of the buffered audio, which may be retrieved from buffer 40 and streamed to terminal 50. If live audio and buffered audio are transferred concurrently, audio captured before signalling the alarm condition (and before the operator's attention to premises 28) may be available almost immediately. In alternate embodiments, the complete audio data may only be available upon completion of the two-way communication, but may be still be useful for investigative purposes or archiving, and accessible through a user interface.

In alternate embodiments, data in buffer 68 at panel 22 may be transferred to monitoring center 26 after the connection resulting from the sensed alarm between panel 22 and center 26 has terminated. The same (or another) connection may be used to transfer the buffered data from panel 22. This may be convenient if the network(s) connecting panel 22 to center 26 is (or are) not capable of establishing a further concurrent connection.

Conveniently, as audio capture at panel 22 may begins upon occurrence of a trigger event at premises 28, typically before or immediately after sensing any audio at detector 36, buffers 68 and 40 may contain a complete audio record of audio associated with the alarm condition—including audio data representative of audio before and after an operator at terminal 50 of monitoring centre 26 becomes available. As describer, this complete audio record may transferred to buffer 40 and/or database 44.

As will be appreciated, in the depicted embodiment example terminals 50 are connected to servers 32 by a network. They could similarly be attached by conventional video and audio cables. If they are network attached, they do not need to be geographically proximate servers 32, but may be geographically remote and need only form part of monitoring station 26 virtually.

In alternate embodiments, data in buffer 40 may be analysed by software at messaging server 32 to assess the nature of the alarm condition, the presence of an emergency, or the like. More specifically, software at server 32 may analyse the contents of buffer 40 before or while an operator at terminal 50 is listening. Glass breaks, calls for help, or other know noises, and sounds may be recognized and signalled downstream (e.g. to terminal 50).

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. A method of operating an alarm monitoring station, comprising:

a. receiving an alarm signal from an alarm system at a monitored premises;

b. establishing an audio communication channel between the monitoring station and the alarm system;

c. upon establishing the audio communication channel with the premises, and at least prior to establishing a connection with an operator associated with the monitoring station, receiving audio data associated with the alarm signal captured at the premises at least immediately prior to establishing the connection with the operator from the premises at the monitoring station;

d. buffering the audio data captured at the premises immediately prior to establishing the connection with the operator and received from the premises at the monitoring station.

2. The method of claim 1, wherein said audio data comprises at least one of live audio data from the premises and buffered audio data buffered at the premises.

3. The method of claim 2, further comprising signalling the panel to cease to buffer audio at said panel after said connection has been established.

4. The method of claim 3, further comprising analysing audio buffered at said monitoring station to identify the nature of said alarm.

5. The method of claim 2, further comprising merging audio buffered at said panel and audio buffered at said monitoring station.

6. The method of claim 2, wherein said buffering occurs concurrently with said receiving audio data.

7. The method of claim 2, wherein audio data buffered at the premises is received at the monitoring station after live audio data has been received.

8. The method of claim 2, wherein said receiving audio data is performed using a voice over internet protocol (VoIP) connection.

9. The method of claim 1, further comprising providing an operator at said monitoring station said audio data buffered at said monitoring station.

10. An alarm monitoring station in communication with an alarm system at a premises, said monitoring station comprising:

a buffer for buffering audio sensed at said premises, provided by said alarm system;

a network interface interconnecting said alarm system to a network;

a processor, operable to cause said alarm system to receive notification of an alarm condition from said alarm system over said network;

establish a voice communication channel with said alarm system at said premises;

upon establishing the audio communication channel with the premises, and at least prior to establishing a connection with an operator associated with the monitoring station, receive audio data associated with the alarm condition and captured at the premises at least immediately prior to establishing the connection with the operator from the premises; and buffer the audio data captured at the premises immediately prior to establishing the connection with the operator from the premises at the monitoring station.

11. The alarm monitoring station of claim 10, wherein said network interface connects sad alarm system using the internet protocol.

12. The alarm monitoring station of claim 10, wherein said processor is operable to cause said alarm system to buffer and receive audio data concurrently.

13. The alarm monitoring station of claim 10, wherein said audio data comprises at least one of live audio data from the premises and buffered audio data buffered at the premises.

14. The alarm monitoring station of claim 13, wherein said processor is further operable to cause said alarm system to signal the panel to cease to buffer audio at said panel after said connection has been established.

15. The alarm monitoring station of claim 10, wherein said processor is further operable to cause said alarm system to merge audio buffered at said panel and said monitoring station.

16. The alarm monitoring station of claim 10, wherein said processor is further operable to cause said alarm system to provide an operator at said monitoring station said audio data buffered at said monitoring station.

17. The alarm monitoring station of claim 10, wherein said processor is further operable to cause said alarm system to receive audio buffered at the premises at the monitoring station after live audio has been received.

18. The alarm monitoring station of claim 10, wherein said communication channel comprises a voice over internet protocol (VoIP) connection.

19. The alarm monitoring station of claim 10, wherein said processor is further operable to cause said alarm system to analyse audio buffered at said monitoring station to identify the nature of said alarm.

20. An alarm monitoring server, comprising:

a network interface interconnecting said alarm monitoring server to at least one network for receipt of alarm signals and two-way audio communication;

a buffer for buffering received at said alarm monitoring server;

a processor, operable to cause said alarm monitoring server to receive an alarm signal;

establish two-way audio communication with an alarm panel originating said alarm signal;

buffer audio received from said alarm panel as part of said two-way audio communication;

receive from said panel at said alarm monitoring server, audio associated with the alarm signal and buffered and captured at said alarm panel immediately prior to said panel having originated said alarm signal.

21. The alarm monitoring server of claim 20, further comprising a database to store received audio buffered at said panel and said audio received from said alarm panel as part of said two-way audio communication.

22. The alarm monitoring server of claim 20, wherein said processor is further operable to present a user interface at a terminal to allow an operator to obtain details of an alarm condition at said alarm panel originating said alarm signal, and to control playback of audio buffered at said alarm panel.

23. A method of operating an alarm panel that signals sensed alarm conditions at a premises to a monitoring server over a packet switched data network, said method comprising:

a. buffering audio at said premises;

b. upon sensing an alarm condition, contacting a monitoring station and signalling the sensed alarm condition; and c. transferring buffered audio associated with the alarm condition that was buffered at the premises immediately prior to signalling said sensed alarm condition to said monitoring station.

* * * * *

UNITED STATES PATENT AND TRADEMARK OFFICE

CERTIFICATE OF CORRECTION

PATENT NO. : 8,723,665 B2
APPLICATION NO. : 13/191052
DATED : May 13, 2014
INVENTOR(S) : Foisy et al.

It is certified that error appears in the above-identified patent and that said Letters Patent is hereby corrected as shown below:

In the Claims

Column 10, Claim 11, Line 33

"...network interface connects sad alarm system..."
should be corrected to read:
"...network interface connects said alarm system..."

Signed and Sealed this
Sixth Day of January, 2015

Michelle K. Lee

Michelle K. Lee
*Deputy Director of the United States Patent and Trademark Office*